US009400099B2

(12) United States Patent
Kachala

(10) Patent No.: US 9,400,099 B2
(45) Date of Patent: Jul. 26, 2016

(54) LED LIGHT APPARATUS

(71) Applicant: Hinkley Lighting, Inc., Avon Lake, OH (US)

(72) Inventor: Michael Kachala, Avon Lake, OH (US)

(73) Assignee: Hinkley Lighting, Inc., Avon Lake, OH (US)

( * ) Notice: Subject to any disclaimer, the term of this patent is extended or adjusted under 35 U.S.C. 154(b) by 98 days.

(21) Appl. No.: 14/520,519

(22) Filed: Oct. 22, 2014

(65) Prior Publication Data

US 2015/0036318 A1 Feb. 5, 2015

Related U.S. Application Data

(63) Continuation of application No. 13/889,481, filed on May 8, 2013, now Pat. No. 8,882,293.

(60) Provisional application No. 61/722,835, filed on Nov. 6, 2012.

(51) Int. Cl.

| | |
|---|---|
| ***F21V 29/00*** | (2015.01) |
| ***F21V 3/04*** | (2006.01) |
| ***F21V 9/08*** | (2006.01) |

(Continued)

(52) U.S. Cl.

CPC ..... *F21V 29/004* (2013.01); *F21K 9/1355* (2013.01); *F21K 9/56* (2013.01); *F21V 3/0463* (2013.01); *F21V 9/08* (2013.01); *F21V 19/02* (2013.01); *F21V 29/70* (2015.01); *F21V 29/89* (2015.01); *F21Y 2101/02* (2013.01)

(58) Field of Classification Search

CPC ..... F21V 29/004; F21V 29/70; F21V 29/89

USPC ..... 362/235, 373, 101, 191, 184, 206

See application file for complete search history.

(56) References Cited

U.S. PATENT DOCUMENTS

| | | | |
|---|---|---|---|
| 8,143,770 | B2 | 3/2012 | Chan et al. |
| 8,193,688 | B2 | 6/2012 | Chin |

(Continued)

FOREIGN PATENT DOCUMENTS

| | | | |
|---|---|---|---|
| RU | 76418 | U1 | 9/2008 |
| RU | 96696 | U1 | 8/2010 |
| RU | 113874 | U1 | 2/2012 |

OTHER PUBLICATIONS

3M, Technical Data Sheet for 3M Thermally Conductive Adhesive Transfer Tapes 8805-8810-8815-8820, Apr. 2008, 8 pages, St. Paul, MN.

(Continued)

*Primary Examiner* — Anne Hines

(74) *Attorney, Agent, or Firm* — Pearne & Gordon LLP

(57) ABSTRACT

Provided are an illumination device and a light fixture including the illumination device. The illumination device includes a body formed of a thermally-conductive material that includes a planar heat transfer surface and a fastener that is compatible with a base that couples the body to the light fixture. A substrate formed, at least in part from a dielectric material supports an array of light emitting diodes and a plurality of contacts electrically connected to the light emitting diodes. A thermally-conductive planar surface is provided to the dielectric material of the substrate to be placed in thermal communication with the heat transfer surface and conduct heat generated by the light emitting diodes to the body.

25 Claims, 5 Drawing Sheets

(51) Int. Cl.

| | |
|---|---|
| ***F21V 29/70*** | (2015.01) |
| ***F21V 29/89*** | (2015.01) |
| ***F21K 99/00*** | (2016.01) |
| ***F21V 19/02*** | (2006.01) |
| *F21Y 101/02* | (2006.01) |

(56) References Cited

U.S. PATENT DOCUMENTS

| | | | | |
|---|---|---|---|---|
| 8,212,460 | B1 | 7/2012 | Hsieh | |
| 2003/0031015 | A1* | 2/2003 | Ishibashi | F21K 9/135 362/235 |
| 2009/0116251 | A1* | 5/2009 | Harbers | F21V 7/041 362/373 |
| 2010/0314986 | A1 | 12/2010 | Gershaw | |
| 2011/0169406 | A1 | 7/2011 | Weekamp et al. | |
| 2012/0049732 | A1 | 3/2012 | Chuang | |
| 2012/0147600 | A1 | 6/2012 | Li | |
| 2013/0058087 | A1* | 3/2013 | Chang | F21V 21/03 362/249.02 |

OTHER PUBLICATIONS

International Search Report and Written Opinion from related PCT Application Serial No. PCT/US2013/068772.

* cited by examiner

LED LIGHT APPARATUS

CROSS-REFERENCE TO RELATED APPLICATIONS

This application is a continuation of U.S. patent application Ser. No. 13/889,481 filed May 8, 2013, which claims the benefit of U.S. Provisional Application No. 61/722,835, filed Nov. 6, 2012. The contents of each of the foregoing are incorporated herein by reference in their entirety.

BACKGROUND OF THE INVENTION

1. Field of the Invention

This application relates generally to an illumination device and, more specifically, to a LED illumination device that establishes a thermally-conductive pathway between a LED light, a heat sink, and a light fixture including the LED illumination device.

2. Description of Related Art

Incandescent lights having a bi-pin connector such as those commonly referred to as "G9" type lights, for example, are typically used in light fixtures installed at locations such as bathrooms. Such lights have a pair of spaced-apart pins electrically connected to a filament that, when energized, emits light. However, such lights are inefficient and convert a large portion of the electric energy received into heat, requiring the lights to be installed in a socket formed from a ceramic material or other suitable thermal insulator. The insulating material thermally insulates the light from its supporting fixture to prevent the fixture itself from becoming too hot.

Attempts to utilize more efficient light sources such as LED lights in G9-compatible sockets have focused on providing a G9-compatible pin arrangement to a LED array. Lamps including such LED arrays typically include many low-power LED bulbs electrically connected to a G9-compliant connector that can be installed in a conventional G9-compliant socket. Since such sockets supply AC electric power, however, each lamp is also provided with an onboard AC-to-DC converter circuit, which increases the cost of the lamps.

Although LED bulbs operate at a lower temperature than their incandescent counterparts, the heat generated by the LEDs must be dissipated to prevent it from degrading the LED efficiency. In an effort to minimize the heat generated, conventional devices have traditionally utilized a large number of low-power LED chips spaced apart from each other. Including too few of the low-power LEDs in the array (or LEDs of insufficient power-rating) results in an insufficient amount of visible light being emitted to adequately replace an incandescent bulb. And including too many of the low-power LEDs in the array can result in a power consumption that at least partially offsets the power savings that make LEDs an attractive alternative to incandescent bulbs.

BRIEF SUMMARY OF THE INVENTION

According to one aspect, the subject application involves an illumination device including a body formed of a thermally-conductive material that includes a planar heat transfer surface and a fastener that is compatible with a base that couples the body to the light fixture. A substrate formed, at least in part from a dielectric material, supports an array of light emitting diodes and a plurality of contacts electrically connected to the light emitting diodes. A thermally-conductive planar surface is provided to the dielectric material of the substrate to be placed in thermal communication with the heat transfer surface and conduct heat generated by the light emitting diodes to the body.

According to another aspect, the subject application involves a light fixture including a plurality of bases, and a plurality of wires that extend through each of the plurality of bases for conducting electric power. An illumination device is coupled to each of the plurality of bases, and includes a body formed of a thermally-conductive material. The body also includes a substantially-planar heat transfer surface and a fastener coupled to one of the bases. A substrate formed at least in part of a dielectric material supports an LED array including a plurality of light emitting diodes and a plurality of contacts electrically connected to the LED array and the wires extending through the base to which the body is coupled. A thermally-conductive planar surface is provided to the dielectric material that is to be placed in thermal communication with the heat transfer surface to conduct heat generated by the LEDs to the body.

BRIEF DESCRIPTION OF SEVERAL VIEWS OF THE DRAWINGS

The invention may take physical form in certain parts and arrangement of parts, embodiments of which will be described in detail in this specification and illustrated in the accompanying drawings which form a part hereof and wherein.

DETAILED DESCRIPTION OF THE INVENTION

Figure 1:
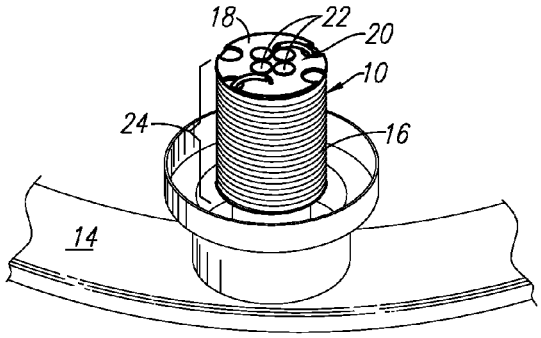
FIG. 1 is a perspective view of a LED illumination device installed on a light fixture.

Certain terminology is used herein for convenience only and is not to be taken as a limitation on the present invention. Relative language used herein is best understood with reference to the drawings, in which like numerals are used to identify like or similar items. Further, in the drawings, certain features may be shown in somewhat schematic form.

It is also to be noted that the phrase "at least one of", if used herein, followed by a plurality of members herein means one of the members, or a combination of more than one of the members. For example, the phrase "at least one of a first widget and a second widget" means in the present application: the first widget, the second widget, or the first widget and the second widget. Likewise, "at least one of a first widget, a second widget and a third widget" means in the present application: the first widget, the second widget, the third widget, the first widget and the second widget, the first widget and the third widget, the second widget and the third widget, or the first widget and the second widget and the third widget.

Figure 8:
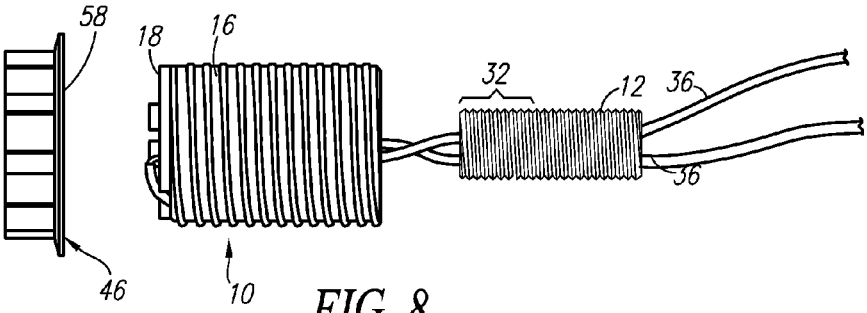
FIG. 8 is a side, partially-exploded view of a LED illumination device.

An illustrative embodiment of an LED illumination device 10 is shown in FIG. 1 installed on a base 12 (FIGS. 2 and 8) of a light fixture 14. The base 12 is described herein as a ⅛-27 NPSM nipple formed from copper, steel with zinc plating, brass or other thermally-conductive metal, for example, provided to a G9 candelabra-type light fixture 14 that supports a plurality of the LED illumination devices 10 to clearly describe the present technology. Such a base 12 includes an annular, substantially cylindrical metal tube defining an interior passage through which wires 36 that are to conduct DC electric power used to illuminate the fixture 14 extend. But it is to be understood that the present embodiment is described for illustrative purposes, and that the scope of the present disclosure is not so limited.

As shown in FIG. 1, the LED illumination device 10 includes a body 16 on which a substrate 18 supporting an array 20 of LEDs 22 rests. The body 16 of the illustrative embodiment is generally cylindrical in shape, formed from a solid aluminum ingot or bar, for example. Alternate embodiments can utilize a body 16 formed by die casting a metal alloy including zinc, aluminum, magnesium, copper, other thermally-conductive material, or any combination thereof. For instance, the body 16 can be formed by die casting a material commonly referred to as zamak (ZA3), but any other suitable thermal conductor is also includes within the scope of the present disclosure. The material forming the body 16 can optionally include one or more materials also forming the base 12 to minimize galvanic reduction. An externally-threaded portion 24 extends along a substantial portion, and optionally the entire length of the body 16 along a longitudinal axis that is concentric with a bore 26 described below and shown in FIG. 5. Alternate embodiments of the body 16 can be formed from other thermally-conductive materials such as metals (e.g., copper, steel, etc . . . ), metal alloys, and any other material having a thermal conductivity of at least 10 W/(m·K) at 25° C. Metallic embodiments of the body 16 are also electrically conductive, thereby establishing an electrically-conductive pathway between the body 16 and the base 12 when they are coupled together as described herein. Thus, stray current introduced to the body 16 can be conducted to the base 12, and optionally other portions of the fixture 14 through the base 12 when assembled, resulting in operation of a circuit interrupter or other such device to interrupt the supply of such stray current.

Figure 5:
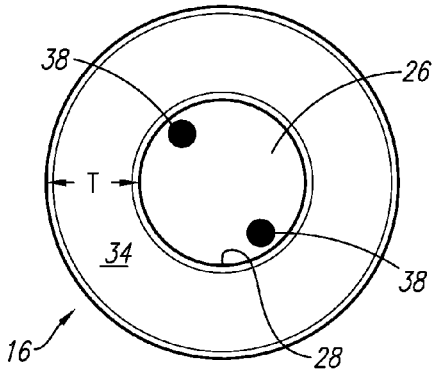
FIG. 5 is a bottom view into a bore formed in a body of the LED illumination device, wherein the bore is to receive a portion of a base provided to a light fixture to install the LED illumination device onto the light fixture.

An embodiment of a bore 26, shown in FIG. 5, is defined by an internally-threaded surface 28 of the body 16, and has a depth of approximately half the length of the body 16. In other words, the bore 26 according to the present embodiment extends about half way through the body 16 in a lengthwise direction along the longitudinal axis, but terminates short of a heat transfer surface 30 (FIG. 7) at a terminal end of the body 16 against which the substrate 18 supporting the array 20 of LEDs 22 is to rest. Thus, a portion of the material forming the body 16 remains between the terminal end of the bore 26 and the heat transfer surface 30. Although described as extending approximately half the length of the body 16, alternate embodiments of the bore 26 can have any desired depth that is less than the entire length of the body 16. Yet other embodiments of the bore 26 can extend entirely through the body 16, forming an annular ring of the material forming the body 16 similar to the annular portion of the body 16 described below with reference to FIG. 5.

Figure 2:
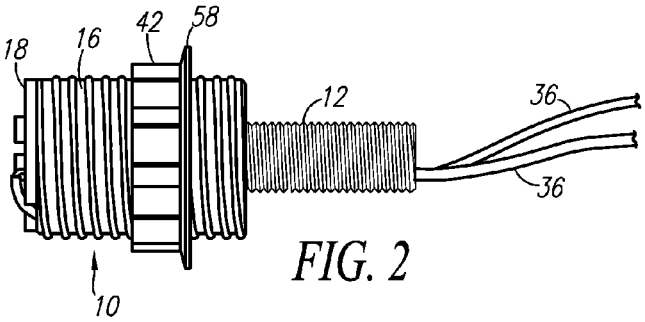
FIG. 2 is a side view of a LED illumination device at least partially installed on a base that has been removed from a light fixture.

The diameter of the bore 26 is suitable for the threading provided to the internally-threaded surface 28 to cooperate with an externally-threaded portion 32 (FIG. 8) of the base 12, thereby removably coupling (e.g., capable of repeated installation and removal without incurring structural damage preventing further use) the body 16 to the base 12 as shown in FIG. 2. The wall thickness T (FIG. 5) of the annular portion 34 of the body material surrounding the bore 26 can be selected to provide the body 16 with sufficient thermal mass to dissipate at least a portion of the heat generated by the array 20 of LEDs 22 for the specific application of the LED illumination device 10. For instance, an embodiment of the body 16 can be formed as a solid metallic structure having a wall thickness T surrounding the bore 26 of at least ⅛ of an inch (⅛ in.), and optionally at least one quarter of an inch (¼ in.).

With the body 16 screwed onto the base 12, cooperation between the internally-threaded surface 28 of the body 16 and the externally-threaded portion 32 of the base 12 provided to the light fixture 14 also establishes a thermally-conductive path along which heat can be conducted from the body 16 to the base 12. The cooperation of these threaded portions involves contact between these metallic surfaces, thereby establishing a continuous, metallic thermally conductive path along which heat from the LEDs 22 can be conducted to the light fixture 14 or other heat sink. From the base 12, the heat can be conducted to another portion of the light fixture 14, thereby expanding the thermal pathways through which heat can be conducted away from the body 16 and dissipated into the ambient environment of the light fixture 14.

Figure 7:
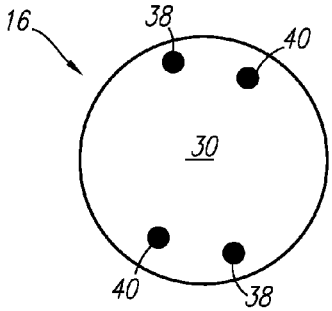
FIG. 7 is a top view of a heat-transfer surface of a body of a LED illumination device.

As shown in FIG. 7, a plurality of apertures are formed adjacent to, or in, the heat transfer surface 30, optionally extending entirely through the heat transfer surface 30. Electrically-conductive wires 36 (FIGS. 2, 8) extend through the one, or a plurality of the apertures 38 to supply electric power to the LEDs 22 on the substrate 18. According to the present embodiment, the apertures 38 extend entirely through the material forming the body 16 that remains between the bore 26 and the heat transfer surface 30. With the LED illumination device 10 installed on the base 12, the wires 36 can extend through the base 12 inserted into the bore 26, and through the apertures 38 to reach the heat transfer surface 30. Since conventional lights are merely provided with a G9-compatible connector to be retrofit into a conventional G9 light fixture 14 supplying AC electric power, such conventional lights are required to include an on-board AC-to-DC converter. The LED illumination device 10 described herein can optionally lack an on-board AC-to-DC converter dedicated to supply DC electric energy specifically to the LEDs 22 on the respective LED illumination device 10. Instead, a common AC-to-DC converter can optionally be provided to the light fixture 14 at a location remote from the LED illumination devices 10 (e.g., separate from the body 16), to convert AC electric power from an AC mains outlet, for example, to DC electric power for each of a plurality of the LED illumination devices 10 provided to the light fixture 14. In other words, a fixture AC-to-DC converter 39 (shown with hidden lines in FIG. 9) can be coupled to the fixture 14 at a location where it is concealed from view when the fixture 14 is observed in a typically installation (e.g., mounted with mounting hardware such as a bracket to a wall structure) in a residential dwelling to supply DC electric power to each of the plurality of illumination devices 10 provided to the fixture 14. When an illumination device 10 is separated (i.e., removed) from the fixture 14, the fixture AC-to-DC converter 39 remains in place on the fixture 14. Thus, AC electric power introduced to the light fixture 14 from an external source (e.g., AC mains wall outlet or wiring) can be converted into DC electric power by circuit components provided to the light fixture 14 and delivered to each of the plurality of LED illumination devices 10 provided to the light fixture 14.

Figure 11:
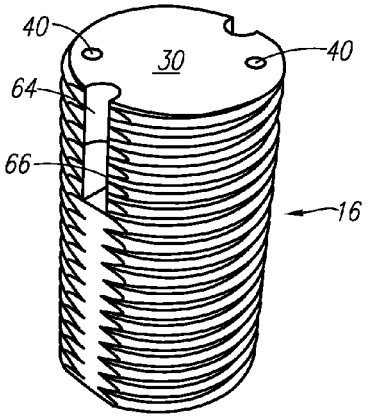
FIG. 11 is a perspective view of an embodiment of a body, where wires extend within a channel formed along a portion of the body's external periphery.

According to alternate embodiments, the wires 36 can optionally extend along a length of the body 16 externally of the bore 26. For example, FIG. 11 shows another illustrative embodiment of the body 16 including a generally C-shaped channel 64 formed to extend along a portion of the external periphery of the body 16, extending lengthwise toward the heat transfer surface 30, to receive the wires 36 supplying DC electric power that extend through the base 12 to the heat transfer surface 30. Such channels can be formed in the body 16 in a manner that involves cutting away a portion of the threading provided to the externally-threaded portion 24 of the body 16, but does not interfere with the threaded engagement between the body 16 and a collar 46 (FIG. 2) with an internally-threaded surface, for example, or other device. An interior passage 66 extends between the bore 26 and the channel 64 to allow the wires 36 to exit the bore 26 and enter the channel 64 en route to the contacts 42 through which electric power is introduced to energize the LEDs 22 as described below.

Figure 12:
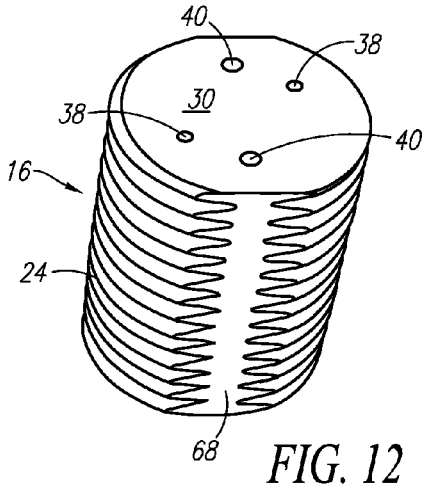
FIG. 12 is a perspective view of an embodiment of a body with a portion of a generally-cylindrical external periphery cutaway.

Another illustrative embodiment of the body 16 appears in FIG. 12. As shown, the body 16 is adapted to be compatible with type-A lamps with an E26 or E27 fitting, for example. As shown, the body 16 includes the threaded portion 24 of the external periphery, with a truncated region 68 extending lengthwise along the body 16. In other words, such an embodiment of the body 16 can be envisioned as including a cylindrical, threaded external surface with a portion of the circumference cut away by a planar surface, optionally on one or opposite sides of the body 16. The remaining portions of the threaded surface remain compatible with the internally-threaded surface 28 of the body 16 defining the bore 26.

At least one, and optionally a plurality of fastener apertures 40 are also formed adjacent to, or through the heat transfer surface 30 to receive fasteners that, when installed, urge the substrate 18 against the heat transfer surface 30. The fastener apertures 40 can extend entirely, or optionally partially through the body material remaining between the bore 26 and the heat transfer surface 30.

Figure 3:
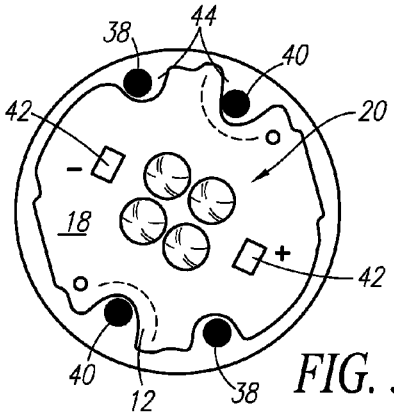
FIG. 3 is a top view of a LED illumination device without electrical connections to an array of LEDs established or a fastener urging a substrate supporting the array toward a body of the LED illumination device.

A top view of an embodiment of the substrate 18 resting on the heat transfer surface 30, without being electrically connected to the wires 36 is shown in FIG. 3. The substrate 18 supports a plurality of LEDs 22 arranged in an array 20. Contacts 42 electrically connected to supply electric power to the LEDs 22 are exposed at an outwardly-facing surface of the substrate 18, a portion (e.g., a layer) of which can be formed from a dielectric material. Thus, electric power introduced to the contacts 42 is conducted by traces, vias, and other conductors known in printed circuit board technology concealed from view by the outwardly facing surface of the substrate 18 to illuminate the LEDs 22. Other circuit components used to supply the electric power to the LEDs 22 can also be supported by the substrate 18. Cutout regions 44 defined by the substrate 18 reveal the apertures 38, 40 that would otherwise be concealed by the substrate 18. According to alternate embodiments, a portion of the overall circuit supply the electric power to the LEDs 22 can be supported by, or optionally within an aperture or cavity defined by the body 16. For example, a current regulator for establishing a desire electric current suitable to power the particular LEDs 22 can be provided to the body 16. Yet other embodiments can distribute the circuit components between on-board components such as the current regulator provided to the body 16 and remote components provided elsewhere on the fixture 14, such as behind, and concealed from view by a back plate. An example of such a remote component includes, but is not limited to a voltage regulator such as a voltage modulator that establishes a desired voltage of the electric power supplied to the circuit components provided to the body 16, and optionally to the circuit components provided to a plurality of different bodies supported by the fixture 14. The electric power with this desired voltage can be received by an on-board current regulator to establish the desired current at the body 16, and optionally at each of the plurality of bodies 16 provided to the fixture 14.

Figure 6:
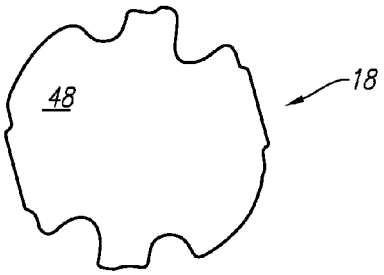
FIG. 6 is a plan view of a contact surface of a substrate supporting an array of LEDs.

An embodiment of an underside 48 of the substrate 18 is shown in FIG. 6. The underside 48 can be coated, laminated to, or otherwise provided with a thermally-conductive material such as a metal or metal alloy. The substrate 18 can be a laminate comprising at least the thermally conductive material exposed at the underside 48 as shown in FIG. 6, a layer of a dielectric material in which the traces, vias and other electrically-conductive pathways are formed and insulated from each other, and the outwardly-facing surface of the substrate 18 provided with the contacts 42 shown in FIG. 3. However, any suitable number of layers to establish the desired electrical connections yet prevent undesired shorts from occurring between each of the contacts 42 and between the contacts 42 and the body 16 is within the scope of the present disclosure. The thermally-conductive material exposed along the underside 48 of the substrate can optionally be electrically insulated from the LEDs 22 by the dielectric material of the substrate 18. However, the dielectric material region of the substrate 18 separating the LEDs 22 from the thermally-conductive material provided to the underside 48 includes dimensions suitable to permit heat generated by the LEDs 22 to be conducted away from the LEDs 22 through that thermally-conductive material toward the heat transfer surface 30 of the body 16.

The thermally-conductive material exposed at the underside 48 (e.g., a material having a thermal conductivity of at least 10 W/(m·K) at 25° C.) is to be placed in close proximity to, and optionally in contact with, the heat transfer surface 30 of the body 16. A thermally-conductive adhesive, such as a silver-containing paste for example, can be applied to promote adhesion between the underside 48 and the heat transfer surface 30, to promote intimate thermal contact between the underside 48 and the heat transfer surface 30, or a combination thereof. According to alternate embodiments, other thermal interface media such as thermally conductive adhesive transfer tape 8805 from 3M™, for example, can be provided to the underside 48 of the substrate 18 to promote a thermally-conductive interface between the substrate 18 and the heat transfer surface 30. The generally-planar heat transfer surface 30 and the similarly-planar underside 48 establish a large surface area through which heat emitted from the LEDs 22 can be conducted from the substrate 18 to the body 16.

Figure 4:
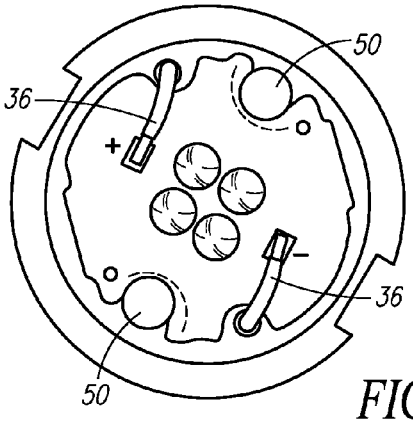
FIG. 4 is a top view of a LED illumination device with electrical connections to an array of LEDs established and a plurality of fasteners urging a substrate supporting the array toward a body of the LED illumination device.

As shown in FIG. 4, fasteners 50 formed from a dielectric material such as Nylon (e.g., polyamide materials), for example, can optionally be inserted through the cutout regions 44 defined by the substrate 18 and into the fastener apertures 40 to urge the underside 48 of the substrate 18 toward the heat transfer surface 30. The use of materials such as Nylon or other polymeric materials, for example, to form the fasteners 50 allows the fasteners 50 to be substantially elastically deformed when installed to urge the substrate 18 toward the body 16. Fasteners 50 can optionally include a threaded portion that cooperates with compatible threading provided to the apertures 40 formed in the body 16. When screwed into the apertures 40, a flanged portion forming a head of the fastener 50 can make contact with the outwardly exposed surface of the substrate 18. Continued insertion of the fasteners 50 can cause the threaded portion thereof to be further inserted into the apertures 40, thereby elongating the fastener 50 as the head remains in contact with the exposed surface of the substrate 18. This elongation can exert a suitable urging force on the substrate 18 without damaging the substrate 18 or body 16, and can accommodate thermal expansion and/or contraction that may occur as a result of the heat generated by the illumination device 10. Such fasteners 50, formed from a dielectric material, also guard against electrical shorts between the substrate 18 and the body 18. With the substrate 18 in place, the wires 36 extending through the apertures 38 can be soldered or otherwise coupled in an electrically-conductive manner to the contacts 42.

The LEDs 22 can be selected to emit any desired wavelength of light to emit a desired light color (e.g., color temperature). The LEDs 22 can optionally be selected to include a lens or cover provided with a phosphor coating to alter the wavelength of light emitted to achieve a desired light color. However, alternate embodiments of the LEDs 22 can lack such a coating, natively emitting a blue or other-colored light instead depending on the semi-conducting materials used in forming the LED. A decorative shade 52 having a phosphor coating such as that shown in FIG. 9, for example, can be coupled to the body 16 or other portion of the LED illumination device 10 to absorb the native light emitted by the LEDs 22 at its native wavelength, or otherwise alter the wavelength or other property of the light, to emit light of the desired wavelength.

Figure 9:
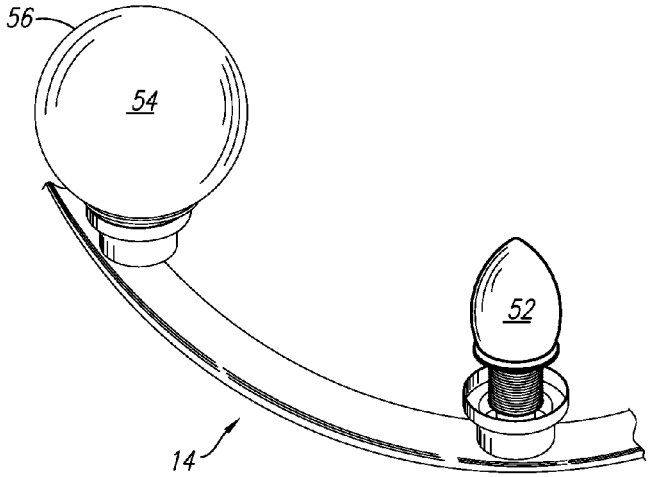
FIG. 9 is a perspective view of a plurality of LED illumination devices installed on a light fixture coupled to a wall structure by mounting hardware, including a LED illumination device with a conically-shaped shield comprising a phosphor coating that at least partially encapsulates a plurality of royal-blue LEDs to produce an omni-directional distribution of light.

Another decorative shade 54 can optionally be placed over the body 16 to also conceal the body 16, or a portion thereof, from view, as shown in FIG. 9. With the shade 54 in place, the collar 42 (FIGS. 2 and 8) can be inserted through an aperture 56 leading to an interior of the shade 54, and placed over a base of the shade 54. The diameter of a flange 58 (FIGS. 2 and 8) protruding outwardly from the collar 42 is greater than a dimension of an aperture through which the body 16 extends while the shade 54 is in place, thereby interfering with removal of the shade 54.

Figure 10:
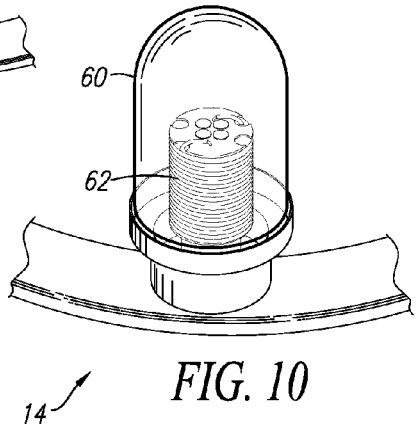
FIG. 10 is a perspective view of a LED illumination device installed on a light fixture, the LED illumination device including a plurality of white LEDs that produce a substantially uni-directional distribution of light.

FIG. 10 illustrates another embodiment of a shade 60 that can be provided to the LED illumination device 10. As shown in FIG. 10, the shade 60 is formed from a substantially-transparent glass, and includes an internally-threaded base region 62. The threading provided to the internally-threaded base region 62 engages the threading provided to the externally-threaded portion 24 of the body 16, thereby securing the shade 60 in place to encapsulate the LEDs 22.

To install the illumination device 10 on the fixture 14, a conventional G9 or other type of bulb and socket, along with an existing base, can be removed from the fixture 14. The existing base can be reused if it includes the externally-threaded portion 32, or a replacement base 12 compatible with the fixture 14 and including the externally-threaded portion 32 can be provided. The proximate end of the bore 26 is positioned concentrically over the end of the base 12 and rotated such that the internal threads within the bore 26 cooperate with the externally-threaded portion 32 of the base 12. Wires 36 (e.g., one positive and the other a reference potential) of the fixture 14 for conducting DC electric energy to be delivered to the LEDs 22 that extend through the interior passage of the base 12 are fed through an opposite end of the base 12 and into the bore 26 defined by the body 16. Terminal ends of the wires 36 are fed through the apertures 38 in the heat transfer surface 30 to be electrically connected to the contacts 42 provided to the substrate where the DC electric energy is to be supplied to the LEDs 22. The present embodiment allows for relative rotation between the body 16 and the base 12 without twisting the wires 36 as a result.

According to alternate embodiments, the wires can be inserted through the base 12 prior to the body 16 being screwed onto the externally-threaded portion 32 of the base 12. Thereafter, the body 16 is lowered to be concentric with the externally-threaded portion 32 of the base 12 and rotated relative to the base 12 so as to be screwed onto the base 12. The length of the wires 36 allows them to be twisted as a result of rotation of the body 16 without being damaged.

According to yet other embodiments, the wires 36 can be segments that are to be added as extensions to the existing wires provided to the fixture 14. For example, the wires 36 can be separate from the fixture 14, and the terminal ends of the wires 36 inserted into the apertures 38 and fed downwardly through the bore 26 and then internal passage of the base 12 from the heat transfer surface 30. One end of the wires 36 can remain extending outwardly from the heat transfer surface 30 to be electrically connected by soldering or otherwise to the contacts 42 of the substrate 18. The opposite ends of the wires 36 that were fed through the bore 26 and base 12, can be soldered or otherwise electrically connected to wiring provided to the fixture 14. For example, the wiring provided to the fixture 14 can be existing wiring, or can be wiring that extends from an aftermarket AC-to-DC converter added to the fixture 14 for supplying DC electric power to the plurality of illuminating devices 10 provided to the fixture 14.

Regardless of the order and manner in which the body 16 is coupled to the base 12 and the wires 36 installed, the substrate 18 supporting the LEDs 22 can be installed on the heat transfer surface 30. A metallic or otherwise thermally-conductive coating provided to the underside 48 of the substrate can be placed in direct contact with the heat transfer surface 30, or enhanced thermal contact can be established through an intermediary material such as thermally-conductive paste or tape. Once in place the fasteners 50 can be installed to provide additional support to the substrate and urge the substrate 18 toward the heat transfer surface 30. The terminal ends of the wires 36 can also be soldered, or otherwise electrically connected to the terminals 42.

If desired, a lens, shade or other cover can be placed over the substrate 18 on the body 16 installed on the fixture 14. An optional collar 46 with an internally-threaded passage can be threaded onto the externally-exposed threads of the body 16 to secure the cover in place on the fixture 14.

Figure 13:
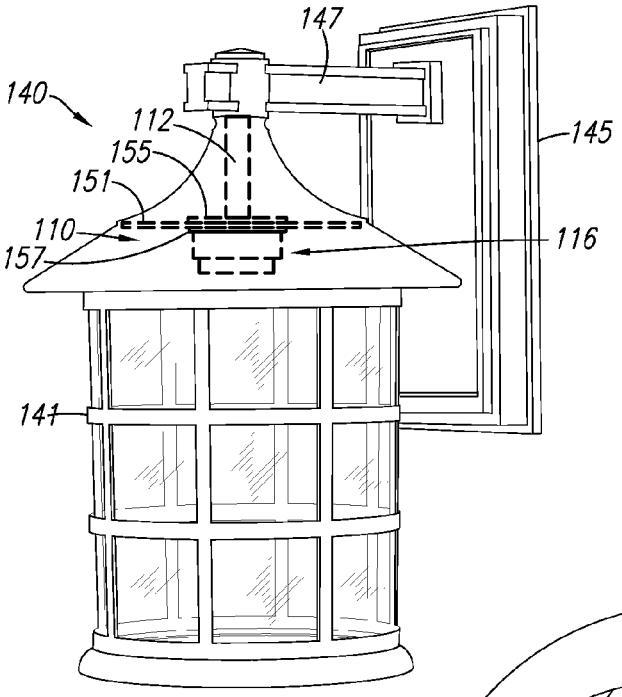
FIG. 13 is a perspective view of a light fixture configured as an outdoor lantern.
Figure 14:
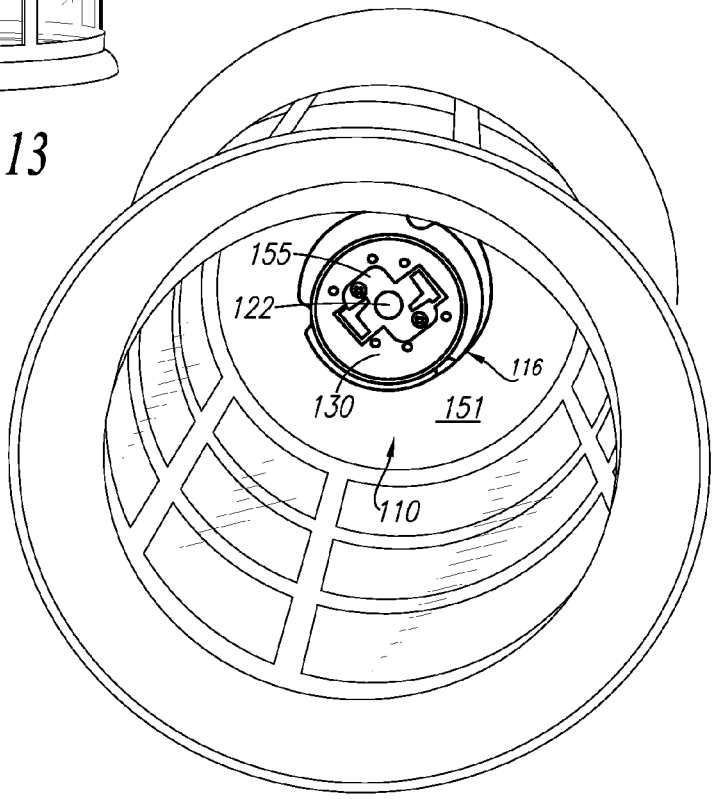
FIG. 14 is a view into a shade provided to an outdoor light fixture, illustrating an embodiment of a LED illumination device supported by such a light fixture.

FIGS. 13 and 14 show another illustrative embodiment of a light fixture 140 including an embodiment of the LED illumination device 110, which is hidden in the view of FIG. 13 and shown in broken lines. The light fixture 140 can be an outdoor light fixture having a shade 141 and mounting plate 145 each formed from a metal or metal alloy, configured to resemble a hanging lantern as shown in FIG. 13. An arm 147 extends between the shade 141 and the mounting plate 145 to form an internal conduit through which electrical wiring can extend to conduct electric power, and can also optionally be formed from a metal or metal alloy.

A base 112 optionally formed from an externally-threaded metal tube extends downwardly from the arm 147 and cooperates with an internally-threaded interior passage defined by a body 116 in a manner similar to that described above for the connection between the base 12 and body 16. The base 112 can also adhere to the ⅛-27 NPSM requirements, or comply with a different size standard for light fixtures 14. A metal washer 151 can optionally be disposed between a flange 155 that projects radially outward from the external periphery of the base 112 and a flange 157 that projects radially outward from a proximate end of the body 116. The metal washer 151 adds to the thermal mass for dissipating heat generated by an LED 122 (FIG. 14) supported on a substrate 118 in thermal communication with a heat transfer surface 130 adjacent to a distal end of the body 116. Contact between the metal washer 151 and the flange 157 establishes a suitable surface area through which heat is to be conducted away from the body 116. The metal washer 151 can optionally be placed in contact with portions of the shade 141 to establish a thermally-conductive pathway between the body 116 and the shade 141 through which heat can conducted away from the body 116 to the shade 141, and optionally any other thermally-conductive materials in thermal communication with the shade 141, such as the arm 147 and the mounting plate 145, for example. Embodiments of the metal washer 151 can be configured with dimensions specific to the light fixture 140 on which it is to be installed.

As shown in FIG. 14, looking into the shade 141, a substrate 118 supporting a single LED 122 is coupled against the heat transfer surface 130 of the body 116. Although only a single LED 122 is shown in the embodiment of FIG. 14, a plurality of LEDs 122 could be utilized without departing from the scope of the present disclosure. As described above, a thermally conductive paste, thermal tape, or other substance promoting intimate thermal contact between a metallic underside of the substrate 118 and the heat transfer surface 130 can be disposed there between the substrate 118 and the heat transfer surface 130.

Figure 15:
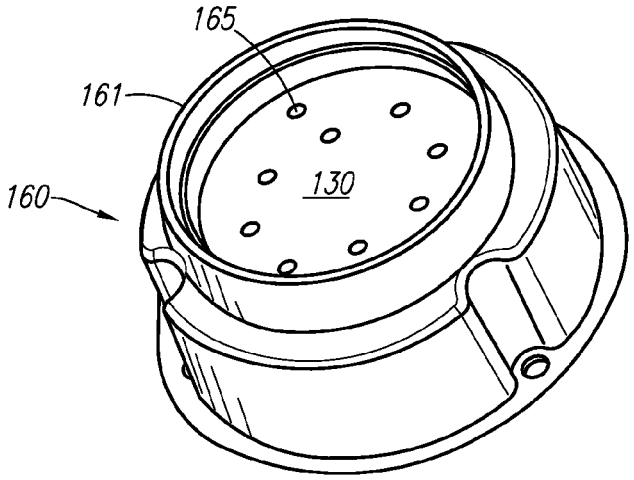
FIG. 15 is a perspective view of an alternate embodiment of a body for installation as part of an outdoor light fixture.
Figure 16:
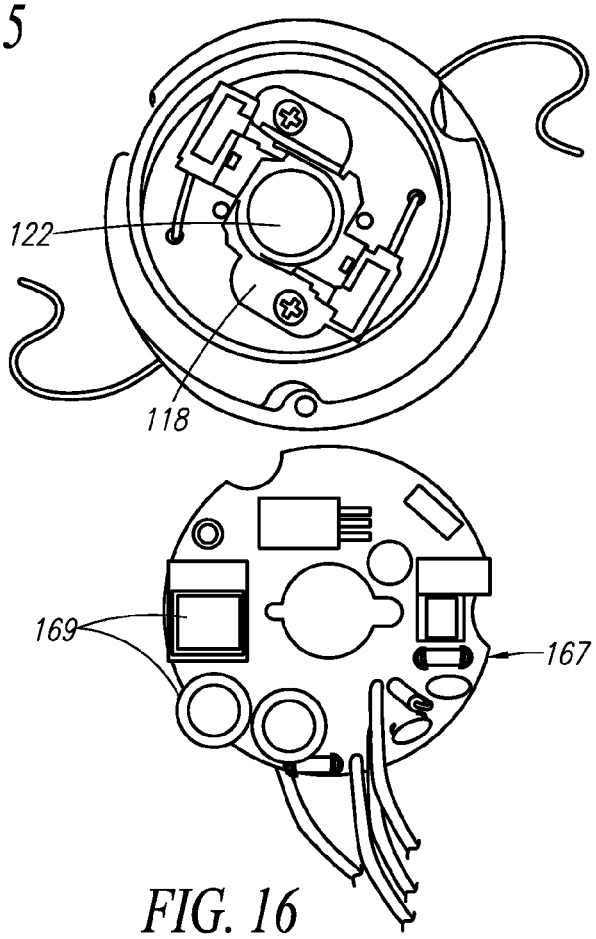
FIG. 16 is a partially exploded view of a substrate supporting a LED on an alternate embodiment of a body and a PCB supporting a conditioning circuit that supplies electric power to the LED.

Unlike the embodiments discussed above, the heat transfer surface 130 is recessed, surrounded by an annular ring 161. Further, a printed circuit board ("PCB") 167, shown in FIG. 16, supporting electronic components 169 forming a driver circuit for conditioning the electric power to be supplied to energize the LED 122 can optionally be disposed within an interior of the body 116. For example, the PCB 167 can optionally be coupled against a portion of the material forming the heat transfer surface 130, opposite the substrate 118. The driver circuit can rectify AC electric power to supply DC electric power to the LED 122, can step up/step down the voltage of the electric power supplied, or a combination thereof. In other words, the substrate 118 can be supported adjacent to the heat transfer surface 130, and the PCB 167 can be supported adjacent to an opposite side of the material forming the heat transfer surface 130. A plurality of apertures 165 (FIG. 15) are formed in the heat transfer surface 130 to receive fasteners to hold the substrate 118 in place and/or allow electrical wires to extend through the heat transfer surface 130.

Illustrative embodiments have been described, hereinabove. It will be apparent to those skilled in the art that the above devices and methods may incorporate changes and modifications without departing from the general scope of this invention. It is intended to include all such modifications and alterations within the scope of the present invention. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An illumination device comprising:

a body formed of one or more thermally-conductive materials, the body comprising a heat transfer surface and defining an internally-threaded bore; and a substrate formed at least in part of a dielectric material that supports at least one LED, wherein a thermally-conductive coating or layer is provided to the dielectric material, said thermally-conductive coating or layer being in thermal communication with the heat transfer surface to conduct heat generated by the at least one LED to the body.

2. The illumination device of claim 1, wherein the one or more thermally-conductive materials and the thermally-conductive coating or layer each comprises a metal having a thermal conductivity of at least 10 W/(m·K) at 25° C.

3. The illumination device of claim 1, wherein the thermally-conductive coating or layer of the substrate is placed in direct physical contact with the heat transfer surface, without any intermediary materials there between.

4. The illumination device of claim 1, wherein the thermally-conductive coating or layer of the substrate is placed in enhanced thermal contact with the heat transfer surface, with a thermally-conductive intermediary material disposed between the thermally-conductive coating or layer of the substrate and the heat transfer surface of the body.

5. The illumination device of claim 1, further comprising a plurality of substantially-elastically deformable fasteners, wherein the body comprises a plurality of fastener apertures that each receive one of the plurality of substantially-elastically deformable fasteners that, when installed, urge the substrate toward the heat transfer surface.

6. The illumination device of claim 1, further comprising a removable collar that is to be installed about an external periphery of the body, wherein the body further comprises an externally threaded portion with threads that cooperate with an internally-threaded portion of the collar.

7. The illumination device of claim 1, further comprising a cover that conceals the at least one LED from view when the illuminating device is illuminated.

8. The illumination device of claim 7, wherein the cover comprises a coating that alters a wavelength of light emitted by the at least one LED.

9. The illumination device of claim 1, each of said heat transfer surface and said thermally-conductive coating or layer being substantially planar.

10. The illumination device of claim 1, said substrate further supporting a plurality of contacts electrically connected to the at least one LED.

11. The illumination device of claim 10, wherein the body comprises a plurality of apertures formed adjacent to the heat transfer surface through which wires conducting DC electric energy are to extend en route to the plurality of contacts supported by the substrate.

12. The illumination device of claim 11, wherein the plurality of apertures extend through the heat transfer surface and the substrate comprises a shape that avoids interfering with extension of the wires through the heat transfer surface to the contacts.

13. An illumination device comprising:

a body formed of one or more thermally-conductive materials, the body comprising a heat transfer surface and defining an internally-threaded bore; and a substrate formed at least in part of a dielectric material that supports at least one LED and a plurality of contacts electrically connected to the at least one LED, wherein a thermally-conductive surface is provided to the dielectric material, said thermally-conductive surface being configured to conduct heat generated by the at least one LED to the body when placed in thermal communication with said heat transfer surface, said internally-threaded bore extending along a longitudinal axis of the body in a direction generally toward the heat transfer surface and being terminated short of the heat transfer surface.

14. A light fixture comprising:

a plurality of bases; and an illumination device coupled to each of the plurality of bases, each of the illumination devices comprising:

a body formed of one or more thermally-conductive materials, the body comprising a heat transfer surface and an internally-threaded bore that is cooperable with external threading of the associated base; and a substrate formed at least in part of a dielectric material that supports at least one LED and a plurality of contacts electrically connected to the at least one LED and to wires for delivering electrical energy to the at least one LED, wherein a thermally-conductive surface is provided to the dielectric material that is to be placed in thermal communication with the heat transfer surface to conduct heat generated by the at least one LED to the body.

15. The light fixture of claim 14, wherein the bases, the one or more thermally-conductive materials and the thermally-conductive surface each comprises a metal having a thermal conductivity of at least 10 W/(m·K) at 25° C.

16. The light fixture of claim 14, further comprising an AC-to-DC converter that is operable to convert AC electric energy into DC electric energy that is to be conducted by said wires for energizing the at least one LED provided to each of the plurality of illumination devices.

17. The light fixture of claim 14, wherein the internally-threaded bore extends along a longitudinal axis of the body in a direction generally toward the heat transfer surface and is terminated short of the heat transfer surface.

18. The light fixture of claim 14, wherein the body comprises a plurality of apertures formed adjacent to the heat transfer surface through said wires extend en route to the plurality of contacts supported by the substrate.

19. The light fixture of claim 14, at least one said illumination device further comprising a cover that conceals the at least one LED thereof from view when the light fixture is illuminated.

20. The light fixture of claim 19, wherein the cover comprises a coating that alters a wavelength of light emitted by said at least one LED.

21. An illumination device comprising:

a body formed of one or more thermally-conductive materials, the body comprising a heat transfer surface and being compatible with a base that is to couple the body to a light fixture; and a substrate formed at least in part of a dielectric material that supports at least one LED, wherein a thermally-conductive coating or layer is provided to the dielectric material, said thermally-conductive coating or layer being in thermal communication with the heat transfer surface via an interface that provides intimate thermal contact therebetween to conduct heat generated by the at least one LED to the body.

22. The illumination device of claim 21, each of said heat transfer surface and said thermally-conductive coating or layer being substantially planar.

23. The illumination device of claim 21, wherein the thermally-conductive coating or layer of the substrate is placed in enhanced thermal contact with the heat transfer surface, with a thermally-conductive intermediary material disposed between the thermally-conductive coating or layer of the substrate and the heat transfer surface of the body.

24. The illumination device of claim 21, further comprising a removable collar that is to be installed about an external periphery of the body, wherein the body further comprises an externally threaded portion with threads that cooperate with an internally-threaded portion of the collar.

25. The illumination device of claim 21, further comprising a cover that conceals the at least one LED from view when illuminated, said cover comprising a coating that alters a wavelength of light emitted by the at least one LED.

* * * * *